United States Patent [19]

Burgess et al.

[11] Patent Number: 4,625,460

[45] Date of Patent: Dec. 2, 1986

[54] FIXTURE FOR USE IN NON-ENCAPSULATED CROSS-SECTIONING OF A COMPOSITE STRUCTURE

[76] Inventors: David L. Burgess; Orlin D. Trapp, both of 51 Hillbrook Dr., Portola Valley, Calif. 94025

[21] Appl. No.: 430,849

[22] Filed: Sep. 30, 1982

[51] Int. Cl.[4] ..... B24B 7/00

[52] U.S. Cl. ..... 51/125; 51/220; 51/229; 269/279; 269/282

[58] Field of Search ..... 51/220, 221, 229, 122, 51/216 R, 125, 216 LP, 218; 269/88, 279, 280, 281, 282, 283, 284; 76/82, 82.2, 85, 88

[56] References Cited

U.S. PATENT DOCUMENTS

| | | | |
|---|---|---|---|
| 437,747 | 10/1890 | Barber | 51/122 |
| 632,755 | 9/1899 | Schipke | 76/88 |
| 1,925,808 | 9/1933 | Kelsey | 51/221 R |
| 2,893,179 | 7/1959 | Sperow | 51/221 R |
| 3,948,006 | 4/1976 | Waldman | 51/229 |
| 4,365,447 | 12/1982 | Dholakia | 51/220 |

OTHER PUBLICATIONS

J. J. Gajda et al., "Semiconductor Structure Enhancement for SEM Analysis", given at the International Symposium for Testing and Failure Analysis, Los Angeles, CA., Oct. 1981.

*Primary Examiner*—Frederick R. Schmidt
*Assistant Examiner*—Judy J. Hartman
*Attorney, Agent, or Firm*—Flehr, Hohbach, Test, Albritton & Herbert

[57] ABSTRACT

A fixture for use in the non-encapsulated cross-sectioning of a composite structure. The fixture comprises a base having a ridge formed in the lower surface thereof for supporting the base on a grinding disc for cross-sectioning of the composite structure. The fixture further comprises a mounting member removably secured to that end of the base opposite the ridge. The mounting member extends outwardly from the base, and the composite structure is mounted on a front face of the mounting member. The front face of the mounting member has two contiguous but discontinuous surfaces on which the structure may be mounted. Either perpendicular or angled sections may be formed in the structure, depending upon which surface of the front face the structure is mounted.

18 Claims, 6 Drawing Figures

FIXTURE FOR USE IN NON-ENCAPSULATED CROSS-SECTIONING OF A COMPOSITE STRUCTURE

The present invention relates generally to techniques for microsectioning composite structures, and more particularly, to a specific apparatus for the non-encapsulated cross-sectioning of a composite structure.

One common way to examine semiconductor structures and other composite structures of minute dimension, for example, a vertical dimension in the submicron range, is metallographic sectioning. With this technique, a section is taken through the structure, and the sectioned portion of the structure is examined with an electron microscope, scanning (SEM). Two different metallographic sectioning techniques may be used. One technique is an encapsulation technique which involves the application of a series of rough, medium and fine polishing steps requiring polishing slurries and a good deal of expertise to carry out. The other technique does not require encapsulation, and it is preferred as it requires less time and is simpler to perform.

The non-encapsulated microsectioning technique involves the use of a steel polishing block upon which the structure to be examined is mounted. The structure extends beyond the edge of the polishing block, and the block is placed on a rotating lapping disc for polishing. The surface of the disc may be frosted glass and is generally lubricated with water. A Mylar® tape is wrapped about one end of the block to present a substantially friction-free surface to the lapping disc. A holding bar maintains the polishing block in position relative to the lapping disc. The structure is lapped until the area of interest is reached. The structure can be observed optically during polishing, and the structure is removed from the polishing block for observation with the SEM.

Problems, however, are encountered in carrying out the non-encapsulated microsectioning technique described. Particularly, the polishing block with the structure mounted thereon is too large in one dimension to fit beneath the lens of an optical microscope, and thus the structure has to be removed from the polishing block to be optically examined along that dimension. Also, the structure has to be removed from the polishing block for examination in the SEM. Removal of the structure from the polishing block, however, is undesirable as the structure is exposed to possible contamination or damage during handling. Additionally, if further polishing of the structure is required, problems are encountered in repositioning and realigning the structure on the polishing block.

An object of the present invention is to provide an improved fixture on which a semiconductor or other composite structure may be mounted during non-encapsulated cross-sectioning.

A more specific object of the present invention is to provide an improved fixture for non-encapsulated cross-sectioning which dispenses with the requirement that the composite structure be removed from the fixture for microscopic examination eliminating the problems associated with the handling and repositioning of the structure on the fixture.

According to the present invention, a fixture for use in non-encapsulated cross-sectioning of a composite structure is provided. The fixture includes a mounting member removably secured to one end of a base. The opposite end of the base has a ridge or step-like section formed in the lower surface of the base for supporting the base and mounting member. The front face of the mounting member extends outwardly from the base, and the structure to be sectioned is mounted on the mounting member's front face. The front face of the mounting member has two contiguous but discontinuous surfaces on which the structure may be mounted. Either perpendicular or angled sections may be formed in the structure, depending upon which surface of the mounting member's front face the structure is mounted.

The present invention will be described in more detail hereinafter in conjunction with the drawings wherein.

Figure 1:
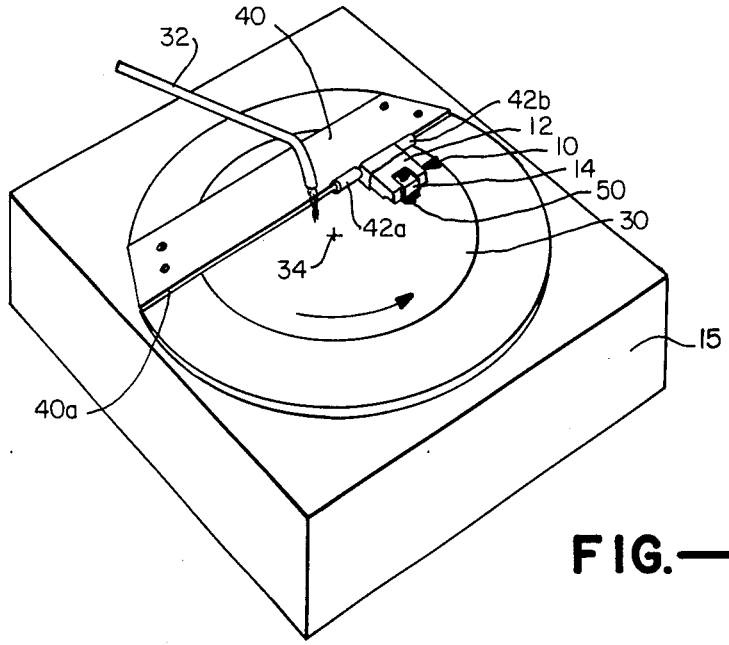
FIG. 1 is a schematic view which illustrates the apparatus of the present invention being used to cross-section a composite structure.

Referring now to the drawings, attention is first directed to FIG. 1 which illustrates the present invention in use for the non-encapsulated cross-sectioning of a composite structure. The sample under examination is a semiconductor structure 50, for example, an integrated circuit or microprocessor, which has been mounted on fixture 10 of the present invention. The present invention, however, is not limited in use to semiconductor structures; it may be used with many types of composite structures. These structures include very small diodes to large VLSI silicon chips, silicon wafers, GaAs chips, photomasks, printed circuit boards (multi- and single-layer), fiber optics, and thin films—single and multiple layers of metals, polycrystaline silicon, oxides (deposited or grown), nitrides, silicides and polycides, baked or cured photoresist, polyimides, and ceramic capacitors or small packages.

Fixture 10 is positioned on a rotating lapping or grinding disc 30 which rotates towards the structure. The fixture is substantially parallel to the surface of disc 30. The grinding disc 30 is preferably an 8 inch frosted plate glass wheel, which is lubricated with water flowing steadily through a conduit 32. Disc 30 is preferably mounted on a variable speed 8 inch polisher 15. A holding bar 40 is provided to maintain fixture 10 in position relative to the grinding disc. The weight of the fixture provides constant pressure on structure 50 in contact with the disc. As disc 30 rotates, fixture 10 is forced against bar 40, causing the structure to be polished by the disc. The structure is ground or polished down to the particular area of interest, that is, the section line. To speed up the operation or for very hard structures, a metal bonded diamond disc may be used in place of the glass wheel.

Holding bar 40 is positioned above disc 30 and is attached to the grinding machine outside the circumference of the disc. Bar 40 is spaced from central axis 34 of the grinding disc so that structure 50 is positioned substantially along a diameter which extends across the disc through its central axis 34. Preferably, the edge portion 40*a* of bar 40 is spaced about one and one-half inches from central axis 34 of disc 30. Bar 40 also includes two plastic cylinders 42*a* and 42*b* for positioning the fixture 10 along edge 40*a* of the bar. Plastic cylinders or positioning clips 42*a* and 42*b* are slidable along edge 40*a* so that fixture 10 can be positioned anywhere along the length of bar 40. To protect and extend the life of the precision glass polishing surface of disc 30, the positioning clips may be periodically moved on bar 40 to use different locations on the surface of disc 30. Bar 40 is preferably made from an acrylic plastic, and the two cylinders are preferably made from PVC.

Figure 2:
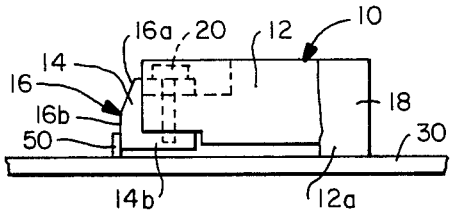
FIG. 2 is a schematic side view which shows a composite structure mounted on the fixture of the present invention wherein a perpendicular section is taken through the structure.
Figure 3:
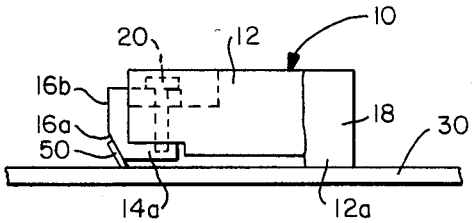
FIG. 3 is a schematic side view which shows a composite structure mounted on the fixture of the present invention wherein an angled section is taken through the structure.

Fixture 10 of the present invention will now be described by referring to FIGS. 2 through 6. As illustrated, fixture 10 comprises a base 12 to which a mounting member or nose piece 14 is removably secured. Base 12 is preferably fabricated from brass, and mounting member 14 is made from steel. The base has a step-like section or ridge 12*a* formed in its lower surface at one end thereof. Ridge 12*a* supports the base and mounting member 14 on grinding disc 30, see FIGS. 2 and 3. The mounting member is removably secured to that end of the base opposite ridge 12*a*. Structure 50 is mounted on a front face 16 of mounting member 14. As shown in FIGS. 2 and 3, the structure extends past the lowermost edge of face 16 to be in contact with grinding disc 30. Preferably, the desired section line through the structure should extend beyond the lowermost edge of face 16 by 20 to 40 mils. The structure is positioned on the mounting member by means of an optical microscope, and it may be bonded thereto by a wax. A piece of Teflon ® tape 18, preferably two layers, or in the alternative a Mylar ® strip, is wrapped about that end of the base in which ridge 12*a* is formed to provide a lubricating layer between ridge 12*a* and the upper surface of disc 30, thereby reducing the force of friction between the two surfaces. The Teflon ® tape also prevents disc 30 from being scored by brass base 12.

Mounting member 14 is a substantially U-shaped member having two parallel arms 14*a* and 14*b*. Arms 14*a* and 14*b* are designed to fit in either a slot 12*b* formed in the upper surface of base 12 or in a recess 12*c* formed in the lower surface of the base. Member 14 is removably secured to base 12 by means of a screw 20 which extends through a slot formed in the arms into a threaded opening 22 in base 12. When mounting member 14 is secured to base 12 and the fixture is positioned on disc 30, the lower edge of the mounting member is spaced from the upper surface of disc 30 so that ridge 12*a* of base 12 supports the base and mounting member on the disc.

Figure 4:
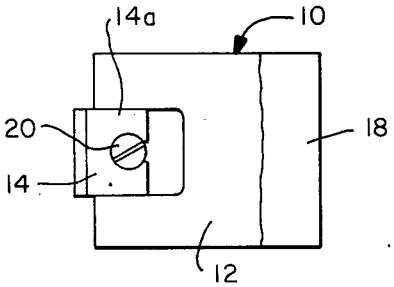
FIG. 4 is a plan view of the fixture of the present invention.
Figure 5:
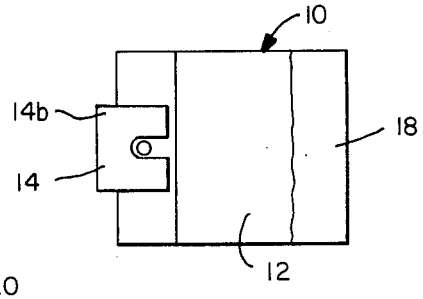
FIG. 5 is a bottom view of the fixture of the present invention.
Figure 6:
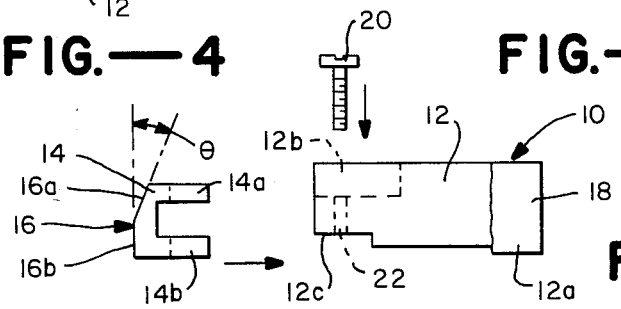
FIG. 6 is a schematic side view which shows the mounting member removed from the base of the fixture of the present invention.

As can be seen from FIGS. 2, 3 and 6, front face 16 of mounting member 14 comprises two contiguous but discontinuous surfaces 16*a* and 16*b*. The mounting member may be attached to the base such that structure 50 may be mounted on either surface 16*a* and 16*b*, and thus mounting member 14 may be thought of as being reversible relative to the base. If mounting member 14 is secured to base 12 with its arm 14*a* in slot 12*b* and structure 50 is attached to surface 16*b* of face 16, see FIG. 2, a perpendicular section is taken through the structure. If mounting member 14 is secured to base 12 with its arm 14*a* in recess 12*c* and structure 50 is mounted on surface 16*a*, see FIG. 3, an angled section is made through the structure. In the embodiment illustrated, the angle "$\theta$", see FIG. 4, is 20°; therefore, the structure is sectioned at an angle of 70° with respect to grinding disc 30. Of course, the structure may be sectioned at other angles by construction mounting member 14 so that the angle "$\theta$" is other than 20°.

Polishing process of the composite structure is periodically checked with an optical microscope. The section line may be observed with a SEM or metallurgical microscope. For observation with the optical microscope, the metallurgical microscope, or the SEM, mounting member 14 may be removed from base 12 by unscrewing screw 20. The mounting member with the structure attached thereto is then ready for examination. With the fixture of the present invention, the composite structure does not have to be dismounted from the mounting member for examination. If further polishing is necessary, the mounting member with the structure mounted thereon is simply reattached to base 12. The mounting member is reattached to the base by inserting either arm 14*a* or 14*b* in slot 12*b*, with the other arm being located in recess 12*c*, and securing the mounting member to base 12 by screw 20. The structure is thus in substantially the same position it was prior to its removal for examination. The present invention greatly simplifies the repositioning of the structure for further polishing. Additionally, as the structure does not have to be dismounted from the mounting member, the structure is less likely to be damaged or contaminated. The present invention also permits the semiconductor structure to be stored on the mounting member for examination or further sectioning at a later time. The entire fixture with the structure mounted thereon easily fits in the SEM or metallurgical microscope. The present invention permits easy, stable inspection with a microscope. Either the top surface of the structure or the polished surface can be conveniently positioned under a microscope objective.

If a very small composite structure, such as a diode chip, is to be sectioned, the chip should first be attached with wax to a piece of a microscope slide. The piece of slide is then attached to the mounting member with wax. The entire operation may be done under a stereo microscope. This permits very small structures to be positioned beyond the edge of the mounting member for accurate sectioning.

Although the invention has been described with reference to a specific embodiment, the description is illustrative of the invention and is not to be considered as limiting the invention. Various modifications and applications may occur to those skilled in the art without departing from the true spirit and scope of the invention as defined by the appended claims.

What is claimed is:

1. A fixture for use in non-encapsulated cross-sectioning of a composite structure, comprising:

a base having a step-like section formed in its lower surface at one end thereof for resting on a grinding surface to support said base thereon;

a mounting member adapted to be removably secured to that end of said base opposite from said step-like section for maintaining the composite structure in position relative to said grinding surface, said mounting member removable from said base with the composite structure mounted thereon; and said mounting member including a substantially U-shaped member having two parallel arms either of which is positionable in a slot formed in the upper surface of said base or in a recess formed in the lower surface of said base wherein said arms are spaced from said grinding surface when so positioned.

2. A fixture for use in non-encapsulated cross-sectioning of a composite structure, comprising:

a base having a ridge formed in its lower surface at one end thereof for resting on a grinding surface to support said base on said grinding surface for cross-sectioning of the composite structure;

a mounting member removably secured to that end of said base opposite said ridge to extend outwardly from said base, the composite structure being mounted on a front face of said mounting member for cross-sectioning on the grinding surface, said mounting member removable from said base with the composite structure mounted thereon; and said front face of said mounting member comprising two contiguous but discontinuous surfaces in which the plane formed by the front surface of one of said contiguous but discontinuous surfaces intersects said grinding surface at a right angle and the plane formed by the front surface of the other of said contiguous but discontinuous surfaces intersects said grinding surface at an angle from the vertical.

3. The fixture of claim 2 wherein said mounting member is securable to said base such that the composite structure may be mounted on one or the other of said contiguous but discontinuous surfaces for cross-sectioning.

4. The fixture of claim 3 wherein said angle from the vertical is 70°.

5. The fixture of claim 2 further including means attached to the lower surface of said base at said ridge for reducing the force of friction between said ridge and said grinding surface.

6. The fixture of claim 5 wherein said friction reducing means is a Teflon® tape.

7. A fixture for non-encapsulated cross-sectioning of a composite structure for use with a rotating horizontally disposed grinding surface and a holding bar overlying the grinding surface, comprising:

an elongated base member having a rear surface adapted to engage and be held against the holding bar, said base member having a lower surface portion adapted to ride upon the grinding surface and said base member having a first recess formed in the same extending through the lower surface so that only said lower surface portion engages the grinding surface;

a mounting member and cooperative mounting means removably securing said mounting member to said base member at a point remote from said rear surface, said mounting member having a nose portion providing a first planar mounting surface and a second planar mounting surface extending at an angle to said first planar mounting surface, the composite structure securable to either said first or second planar mounting surface; and said cooperative mounting means including means for mounting said mounting member on said base member so that either said first or said second planar mounting surfaces may be used for holding the composite structure in contact with the grinding surface, so that the portion of the composite structure to be sectioned engages the grinding surface wherein said mounting member may be removed from said base with the composite structure mounted thereon.

8. The fixture of claim 7 wherein said nose portion has a second planar mounting surface extending at an angle to said first planar mounting surface.

9. The fixture of claim 7 further including means attached to said lower surface portion of said base member for reducing the force of friction between said lower surface portion and the grinding surface.

10. The fixture of claim 7 wherein said mounting member comprises a U-shaped member having two parallel arms either of which is positionable in a slot formed in the upper surface of said base member or in said first recess so that one or the other of said first and second planar mounting surfaces may be used for holding the composite structure in contact with the grinding surface.

11. An apparatus for non-encapsulated microsectioning of a composite structure for use with a rotating disc, comprising:

a base having a ridge formed in its lower surface at one end thereof for supporting said base on the disc for microsectioning of the composite structure;

a mounting member adapted to be removably secured to the end of said base opposite said ridge and a front face of said mounting member adapted to have the composite structure mounted thereon for microsectioning;

a holding bar positioned above the disc and extending across the disc spaced from a central axis thereof for maintaining the composite structure mounted on the front face of said mounting member in a position substantially along a diameter extending through the central axis of the disc; and means on said holding bar for positioning said base along a length of said holding bar.

12. An apparatus for non-encapsulated cross-sectioning of a composite structure for use with a rotating horizontally disposed disc, comprising:

a holding bar overlying the disc and spaced from the central axis thereof;

an elongated base member having a rear surface adapted to engage and be held against said holding bar, said base member having a lower surface portion adapted to ride upon the disc and said base member having a first recess formed in the same extending through the lower surface so that only said lower surface portion engages the disc;

a mounting member and cooperative mounting means removably securing said mounting member to said base member at a point remote from said rear surface, said mounting member having a nose portion providing a first planar mounting surface upon which the composite structure is adapted to be secured to position the composite structure so that the portion to be sectioned engages the disc; and means on said holding bar for positioning said base member in a predetermined radial position on the disc wherein said holding bar maintains the composite structure secured to said first planar mounting surface in a predetermined position along a diameter extending through the central axis of the disc.

13. The apparatus of claim 12 wherein said base member positioning means is a pair of resilient members slidably mounted on an edge of said holding bar.

14. The apparatus of claim 12 wherein said base member positioning means includes first and second retaining members adapted to frictionally engage said holding bar and disposed on opposite sides of said base member.

15. The apparatus of claim 14 wherein each of said retaining members is formed with a slot in which said holding bar can seat.

16. The apparatus of claim 15 wherein each of said retaining members is in the form of a hollow cylinder formed of a resilient material.

17. A fixture for use in non-encapsulated cross-sectioning of a composite structure, comprising:

a base having a ridge formed in its lower surface at one end thereof to support said base on a grinding surface for cross-sectioning of the composite structure;

a mounting member removably securable to that end of said base opposite said ridge to extend outwardly from said base, the composite structure being mountable on a front face of said mounting member for cross-sectioning on the grinding surface, said front face of said mounting member comprising two contiguous but discontinuous surfaces in which the plane formed by the front surface of one of said contiguous but discontinuous surfaces intersects said grinding surface at a right angle and the plane formed by the front surface of the other of said contiguous but discontinuous surfaces intersects said grinding surface at an angle from the vertical; and said mounting member adapted to be removed and resecured to said base with the composite structure mounted thereon such that the composite structure may be in substantially the same position relative to the grinding surface as it was prior to removal of said mounting member from said base.

18. The fixture of claim 2 including means for repeatedly positioning said mounting member on said base.

* * * * *